United States Patent [19]

Nayar

[11] Patent Number: 4,756,850

[45] Date of Patent: Jul. 12, 1988

[54] ARTICLES AND METHODS FOR TREATING FABRICS

[75] Inventor: Bala C. Nayar, Cincinnati, Ohio

[73] Assignee: The Procter & Gamble Company, Cincinnati, Ohio

[21] Appl. No.: 61,060

[22] Filed: Jun. 10, 1987

[51] Int. Cl.[4] ..... C11D 1/65

[52] U.S. Cl. ..... 252/547; 252/8.7; 252/8.75; 252/8.8; 252/91; 252/174.13

[58] Field of Search ..... 252/174, 90, 91, 174.13, 252/8.8, 8.7, 8.75, 8.6, 547

[56] References Cited

U.S. PATENT DOCUMENTS

| | | | |
|---|---|---|---|
| 2,691,636 | 10/1954 | Stayner et al. | 252/544 |
| 3,055,777 | 9/1962 | Grad | 117/212 |
| 3,696,056 | 10/1972 | Inamorato | 252/525 |
| 3,936,537 | 2/1976 | Baskerville, Jr. et al. | 427/242 |
| 4,058,489 | 11/1977 | Hellsten | 252/547 |
| 4,173,539 | 11/1979 | Rule et al. | 252/8.8 |
| 4,179,382 | 12/1979 | Rudkin et al. | 252/8.8 |
| 4,255,484 | 3/1981 | Stevens | 252/8.8 |
| 4,292,035 | 9/1981 | Battrell | 8/137 |
| 4,294,710 | 10/1981 | Hardy et al. | 252/8.8 |
| 4,303,543 | 12/1981 | Mansy | 252/117 |
| 4,375,416 | 3/1983 | Crisp et al. | 252/8.7 |
| 4,511,495 | 4/1985 | Melville | 252/522 |
| 4,514,444 | 4/1985 | Ives et al. | 427/242 |
| 4,589,988 | 5/1986 | Rieck et al. | 252/8.8 |
| 4,661,269 | 4/1987 | Trinh et al. | 252/8.8 |

FOREIGN PATENT DOCUMENTS

| | | |
|---|---|---|
| 818419 | 7/1969 | Canada . |
| 1186458 | 5/1985 | Canada . |
| 133804 | 6/1985 | European Pat. Off. . |
| 1565808 | of 0000 | United Kingdom . |
| 1077104 | 7/1967 | United Kingdom . |
| 1077103 | 7/1967 | United Kingdom . |
| 1230792 | 5/1971 | United Kingdom . |
| 1514276 | 6/1978 | United Kingdom . |

*Primary Examiner*—A. Lionel Clingman
*Assistant Examiner*—Hoa Van Le
*Attorney, Agent, or Firm*—David K. Dabbiere; Steven J. Goldstein; Leonard W. Lewis

[57] ABSTRACT

Disclosed are dryer-added fabric conditioning articles and methods utilizing imidazoline-anionic surfactant ion-pair complexes as fabric conditioning agents. Optionally, these compositions can contain polymeric soil release agents and the fabrics are commingled with the conditioner active and optional components in an automatic laundry dryer and are provided with a soft, antistatic finish concurrently with the drying operation. The fabric conditioning agents herein are preferably employed in combination with a dispensing means adapted for use in an automatic dryer.

16 Claims, No Drawings

ARTICLES AND METHODS FOR TREATING FABRICS

TECHNICAL FIELD

The present invention relates to articles and methods for providing static control and softening benefits to fabrics in an automatic laundry dryer.

BACKGROUND OF THE INVENTION

Treatment in an automatic clothes dryer has been shown to be an effective means for imparting desirable tactile properties to fabrics. For example, it has become common to soften fabrics in an automatic clothes dryer rather than during the rinse cycle of a laundering operation. See, for example, U.S. Pat. No. 3,441,692, Gaiser, issued May 6, 1969.

Fabric softness or conditioning is usually understood to be that quality of the treated fabric whereby its handle or texture is smooth, pliable and fluffy to the touch. Various chemical compounds have long been known to possess the ability to soften fabrics when applied to them during a laundering operation.

Fabric conditioning also connotes the absence of static "cling" in the fabrics, and the commonly used cationic fabric softeners provide both softening and antistatic benefits when applied to fabrics. Indeed, with fabrics such as nylon and polyester, the user is more able to perceive and appreciate an antistatic benefit than a true softening benefit.

Fatty alkyl cationic antistatic softening compounds and compositions designed for application to fabrics in an automatic dryer have been the subject of many innovations. See, for example, U.S. Pat. No. 3,634,947, Furgal, issued Jan. 18, 1972, and U.S. Pat. No. 3,686,025, Morton, issued Aug. 22, 1972. Other fatty materials have been suggested for use as dryer-added fabric softeners. See, for example, U.S. Pat. No. 3,676,199, Hewitt et al., issued July 11, 1972. Included among these prior softening compositions are various glycerides in combination with oil-soluble, lower-ethoxylated surfactants. Triglyceride fabric treating agents are disclosed in U.S. Pat. No. 3,785,973, Bernholz et al., issued Jan. 15, 1974.

The use of primary amines and the salts of such amines as fabric conditioning agents for use in the washing and rinsing cycles of an automatic washer, as well as the drying cycle of an automatic dryer has been disclosed. See, for example, U.S. Pat. No. 3,095,373, Blomfield, issued June 25, 1963; U.S. Pat. No. 3,442,692, Gaiser, issued May 6, 1969; and South African Pat. No. 69/3923. The use of primary amines in a dryer content, however, causes odor problems and paint softening. These problems are overcome with some salts, but not predictably so.

U.S. Pat. No. 4,077,891, Beimesch et al., issued Mar. 7, 1978, discloses the advantages of using the formic acid salt of a long-chain primary amine to impart a softening and antistatic effect to fabrics in an automatic dryer.

It has now been surprisingly discovered that certain imidazoline-anionic surfactant ion-pair complexes are fabric conditioning actives that can provide excellent static control and softness to fabrics in an automatic laundry dryer.

It is therefore an object of the present invention to provide superior static control and softness to fabrics treated with imidazoline-anionic surfactant ion-pair complexes in an automatic laundry dryer.

This and other objects are obtained herein, as will be seen from the following disclosure.

SUMMARY OF THE INVENTION

The present invention relates to an article of manufacture adapted for use to provide fabric care benefits in an automatic laundry dryer comprising:

(a) a fabric conditioning composition comprising one or more of an imidazoline-anionic surfactant ion-pair complex of the formula:

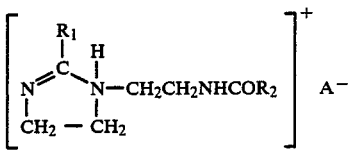

wherein $R_1$ and $R_2$ can independently be $C_{12}$ to $C_{20}$ hydrocarbon, and A is an anionic surfactant selected from the group consisting of aryl sulfonates, alkylaryl sulfonates, paraffin sulfonates, alkyl sulfates, olefin sulfonates, alkyl ethoxylated sulfates, dialkyl sulfosuccinates, ethoxylated alkyl sulfonates, acylisethionates, alkyloxybenzene sulfonates and acylalkyl taurates and mixtures of such ion-pair complexes; and (b) a dispensing means which provides for release of an effective amount of said composition to fabrics in the dryer at automatic dryer operating temperatures.

The most preferred imidazolines are stearylamidoethyl-2-stearyl imidazoline, stearylamidoethyl-2-palmityl imidazoline, stearylamidoethyl-2-myristyl imidazoline, palmitylamidoethyl-2-palmityl imidazoline, palmitylamidoethyl-2-myristyl imidazoline, stearylamidoethyl-2-tallow imidazoline, myristylamidoethyl-2-tallow imidazoline, palmitylamidoethyl-2-tallow imidazoline, coconut amidoethyl-2-coconut imidazoline, hydrogenated tallowamidoethyl-2-hydrogenated tallow imidazoline and mixtures thereof. The most preferred surfactants are the linear $C_8$ to $C_{13}$ alkyl benzene sulfonates.

Optionally, these compositions can contain soil release components which provide soil release benefits for fabrics over a wide range of soils including the oily types and clay soils on polyester and polyester/cotton blend fabrics. These compositions may further comprise optional cationic and/or nonionic fabric softening agents.

The invention also encompasses a method for imparting fabric care benefits in an automatic laundry dryer comprising tumbling said fabric under heat in a clothes dryer with an effective amount of the fabric conditioning composition.

DESCRIPTION OF THE DEVELOPMENT

Fabric Conditioning Agent

The fabric conditioning agent of the present invention comprises water-insoluble imidazoline-anionic surfactant ion-pair complexes which are released from a dispensing means in an automatic laundry dryer.

Preferred imidazoline-derivatives are those wherein $R_1$ and $R_2$ are independently $C_{12}$ to $C_{20}$ alkane and alkene, and more preferably $C_{14}$ to $C_{20}$ alkane. Suitable examples of such imidazoline derivatives include stearylamidoethyl-2-stearyl imidazoline, stearylamidoethyl-2-palmityl imidazoline, stearylamidoethyl-2-myristyl imidazoline, palmitylamidoethyl-2-palmityl imidazoline, palmitylamidoethyl-2-myristyl imidazoline, stearylamidoethyl-2-tallow imidazoline, myristylamidoethyl-2-tallow imidazoline, palmitylamidoethyl-2-tallow imidazoline, coconut amido ethyl-2-coconut imidazoline, tallowamidoethyl-2-tallow imidazoline and mixtures of such imidazoline derivatives. More preferred are those imidazoline derivatives wherein $R_1$ and $R_2$ are independently $C_{16}$ to $C_{20}$ alkane (e.g. wherein $R_1$ and $R_2$ are derived from palmity, stearyl and arachidyl). Most preferred are those imidazoline derivatives wherein $R_1$ and $R_2$ are independently $C_{16}$ to $C_{18}$ alkyl, i.e., wherein $R_1$ and $R_2$ are each derived from hydrogenated tallow.

These imidazoline derivatives can be manufactured, for example, from the reaction of diethylene triamine with the appropriate carboxylic acid. This procedure is set forth in *Kirk-Othmer Encyclopedia of Chemical Technology*, Third Edition, Volume 7, pages 580–600 (Grayson et al., Editors; Wiley-Interscience, N.Y., N.Y.; 1979), which is incorporated by reference herein.

Preferred $C_{16}$ to $C_{18}$ imidazoline derivatives are available from Sherex Corporation as Varisoft® 445 imidazoline. Varisoft® 445 imidazoline may contain up to 50% of non-imidazoline material (e.g., starting materials) which do not adversely affect the fabric care benefits of the present invention.

The anionic surfactants (A) useful in the present invention are aryl sulfonates, alkylaryl sulfonates, paraffin sulfonates, olefin sulfonates, alkyl ethoxylated sulfates, dialkyl sulfosuccinates, ethoxylated alkyl sulfonates, alkyl oxybenzene sulfonates, acyl isethionates and acylalkyl taurates. These classes of anionic surfactants are fully described in U.S. Pat. No. 3,929,678, Laughlin et al., issued Dec. 30, 1975, at column 23, line 58 through column 29, line 23 and in U.S. Pat. No. 4,294,710, Hardy et al., issued Oct. 13, 1981, both of which are incorporated herein by reference.

Particularly preferred surfactants are the linear $C_1$ to $C_{20}$ alkylaryl sulfonates, alkyl ethoxylated sulfates, aryl sulfates and sulfo succinates and most particularly are the linear $C_4$–$C_{13}$ alkylaryl sulfonates. This class of surfactants includes the linear $C_4$ to $C_{13}$ alkyl benzene sulfonates. Most preferred are the linear $C_8$ to $C_{13}$ alkyl benzene sulfonates.

The imidazoline and surfactant components are combined in a mole ratio of imidazoline to surfactant ranging from about 10:1 to about 1:1, preferably from about 8:1 to about 1:1, more preferably from about 5:1 to about 1:1. This can be accomplished by any of a variety of means, including but not limited to, preparing a melt of the surfactant in the acid form and the imidazoline and maintaining the melt stage for about 30 minutes. The above molten ion-pair can be allowed to cool, preferably while stirring the molten mixture under nitrogen.

Other methods of forming this mass include dissolving the components in an organic solvent, or by heating the imidazoline to a liquid state and then adding this molten imidazoline component to a heated acidified aqueous solution of the anionic surfactant, and then extracting the ion-pair complex by using a solvent such as chloroform.

It is to be noted that ion-pairs having different melting points can be obtained by changing the mole ratios of the imidazolines to surfactants and/or by changing the alkyl chain length of either the imidazolines or the surfactants or both.

Suitable non-limiting examples of ion-pair complexes for use in the present invention include:

stearylamidoethyl-2-stearyl imidazoline complexed with a $C_1$–$C_{20}$ linear alkyl benzene sulfonate (LAS),
stearylamidoethyl-2-palmityl imidazoline complexed with a $C_1$–$C_{20}$ LAS,
stearylamidoethyl-2-myristyl imidazoline complexed with a $C_1$–$C_{20}$ LAS,
palmitylamidoethyl-2-palmityl imidazoline complexed with a $C_1$–$C_{20}$ LAS,
palmitylamidoethyl-2-myristyl imidazoline complexed with a $C_1$–$C_{20}$ LAS,
stearylamidoethyl-2-tallow imidazoline complexed with a $C_1$–$C_{20}$ LAS,
myristylamidoethyl-2-tallow imidazoline complexed with a $C_1$–$C_{20}$ LAS,
palmitylamidoethyl-2-tallow imidazoline complexed with a $C_1$–$C_{20}$ LAS,
coconut amidoethyl-2-coconut imidazoline complexed with a $C_1$–$C_{20}$ LAS,
tallowamidoethyl-2-tallow imidazoline complexed with a $C_1$–$C_{20}$ LAS,
stearylamidoethyl-2-stearyl imidazoline complexed with a $C_1$–$C_{20}$ AES,
stearylamidoethyl-2-palmityl imidazoline complexed with a $C_1$–$C_{20}$ AES,
stearylamidoethyl-2-myristyl imidazoline complexed with a $C_1$–$C_{20}$ AES,
palmitylamidoethyl-2-palmityl imidazoline complexed with a $C_1$–$C_{20}$ AES,
palmitylamidoethyl-2-myristyl imidazoline complexed with a $C_1$–$C_{20}$ AES,
stearylamidoethyl-2-tallow imidazoline complexed with a $C_1$–$C_{20}$ AES,
myristylamidoethyl-2-tallow imidazoline complexed with a $C_1$–$C_{20}$ AES,
palmitylamidoethyl-2-tallow imidazoline complexed with a $C_1$–$C_{20}$ AES,
coconut amidoethyl-2-coconut imidazoline complexed with a $C_1$–$C_{20}$ AES,
tallowamidoethyl-2-tallow imidazoline complexed with a $C_1$–$C_{20}$ AES
stearylamidoethyl-2-stearyl imidazoline complexed with an aryl sulfonate,
stearylamidoethyl-2-palmity imidazoline complexed with an aryl sulfonate,
stearylamidoethyl-2-myristyl imidazoline complexed with an aryl sulfonate,
palmitylamidoethyl-2-palmityl imidazoline complexed with an aryl sulfonate,
palmitylamidoethyl-2-myristyl imidazoline complexed with an aryl sulfonate,
stearylamidoethyl-2-tallow imidazoline complexed with an aryl sulfonate,
myristylamidoethyl-2-tallow imidazoline complexed with an aryl sulfonate,
palmitylamidoethyl-2-tallow imidazoline complexed with an aryl sulfonate,
coconut amido ethyl-2-coconut imidazoline complexed with an aryl sulfonate,
tallowamidoethyl-2-tallow imidazoline complexed with an aryl sulfonate The complexes are further characterized by their melting points, which generally lie in the range of from about 10° to about 75° C. Ion-pairs having different melting points can be obtained by changing the mole ratios of the imidazolines to surfactants and/or by changing the alkyl chain length of either the imidazolines or the surfactants or both. This ability to tailor melting points of ion-pair complexes is important for a dryer-added composition to provide fabric conditioning benefits. The most preferred fabric conditioning agents are solid at room temperature, have a softening phase transition temperature at or about about 30° C., and become a flowable liquid below about 100° C., preferably below about 90° C. A fabric conditioning agent which is solid at room temperatures is desirable in order to keep the dryer-added composition from having a tacky feel, while its softening and fluidity at higher temperatures facilitate the substrate coating process and the subsequent fabric conditioning active transfer from the fabric conditioning sheet to the fabrics in the clothes dryer.

OPTIONAL COMPONENTS

Polymeric Soil Release Agent

The polymeric soil release agents useful in the present invention include hydroxyether cellulosic polymers, block copolymers of polyethylene terephthalate and polyoxyethylene terephthalate, block copolymers of polyethylene phthalate and polyethylene glycol, and cationic guar gums, and the like. The soil release agent is present at a level of from about 1% to about 70%, more preferably from about 10% to about 70%, and most preferbly from about 25% to about 50%, by weight of the fabric conditioning composition.

The cellulosic derivatives that are functional as soil release agents may be characterized as certain hydroxyethers of cellulose such as Methocel HB-15000 (Dow), Methyl Cellulose DM-140 (Buckeye), and Klucel (Hercules); also, certain cationic cellulose ether derivatives such as Polymer JR-125, JR-400, and JR-30M (Union Carbide).

Other effective soil release agents are cationic guar gums such as Jaguar Plus (Stein Hall) and Gendrive 458 (General Mills).

A preferred fabric conditioning composition has a polymeric soil release agent selected from the group consisting of methyl cellulose, hydroxypropyl methylcellulose, or hydroxybutyl methylcellulose, said cellulosic polymer having a viscosity in 2% aqueous solution at 20° C. of 15 to 75,000 centipoise.

A more preferred soil release agent is a copolymer having blocks of polyethylene terephthalate and polyoxyethylene terephthalate. More specifically, these polymers are comprised of repeating units of ethylene terephthalate and polyoxyethylene terephthalate at a molar ratio of ethylene terephthalate units to polyoxyethylene terephthalate units of from about 25:75 to about 35:65, said polyoxyethylene terephthalate containing polyoxyethylene blocks having molecular weights of from about 300 to about 700. The molecular weight of this polymeric soil release agent is in the range of from about 25,000 to about 55,000. These preferred polymers are disclosed in U.S. Pat. No. 3,959,230, Hays, issued May 25, 1976, incorporated herein by reference. The melting point of the polymer is preferably below 100° C.

Another preferred polymeric soil release agent is crystallizable polyester copolymer with repeat units of ethylene terephthalate units containing 10–50% by weight of ethylene terephthalate units together with 10–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. A more preferred polymer is that wherein the polyoxyethylene terephthalate units are derived from a polyoxyethylene glycol with an average molecular weight of from about 1,000 to about 4,000. These polymers are disclosed in U.S. Pat. No. 3,416,952, McIntyre and Robertson, issued Dec. 17, 1968, incorporated herein by reference. Examples of these copolymers include the commercially available material Zelcon ® 4780 (from DuPont) and Milease ® T (from ICI), both have the Chemical Abstracts Service Registry No. 9016-88-0. Both Zelcon 4780 and Milease T are sold in the aqueous dispersion form containing up to 85% water. It is preferably to use the dehydrated polymer to prepare the fabric conditioning composition in order to avoid the incorporation of excess moisture which is believed to make the resulting fabric conditioning articles wet and sticky. The dehydrated polymer is obtained by drying the above-mentioned commercial dispersions, or can be obtained directly in the concentrated form from the manufacturers. An example of the latter is Zelcon PG, the concentrated form of Zelcon 4780, and is obtained from DuPont Co.

The most preferred polymer is a solid at room temperature, has a softening phase transition temperature at or above about 30° C. and becomes a flowable liquid below about 100° C., preferably below about 90° C. The softening phase transition temperature can be determined by the differential scanning calorimetry method. A polymer that is a hard solid at room temperature is desirable in order to keep the fabric conditioning sheets from having a tacky feel, while its softening and fluidity at higher temperatures facilitate the substrate coating process and the subsequent fabric conditioning active transfer from the fabric conditioning sheet to the fabrics in the clothes dryer.

A particularly preferred polymeric soil release agent is disclosed in European Patent Application No. 185,417, Gosselink, published June 25, 1986, incorporated herein by reference, has the formula:

$$X\text{-}[(OCH_2CH_2)_n(OR^3)_m]\text{-}[(A\text{—}R^1\text{—}A\text{—}R^2)_u(A\text{—}R^3\text{—}A\text{—}R^2)_v]\text{-}A\text{—}R^4\text{—}A\text{-}[(R^5O)_m(CH_2CH_2O)_n]\text{-}X$$

wherein the A moieties are essentially $$\overset{O}{\overset{\|}{\text{—OC—}}} \text{ or } \overset{O}{\overset{\|}{\text{—CO—}}}$$

moieties; the $R^1$ moieties are essentially 1,4-phenylene moieties; and $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarbylene moieties having at least one $—SO_3M$, —COOM, $—O\text{-}[(R^5O)_m(CH_2CH_2O)_n]\text{-}X$ or $—A\text{-}[(R^2—A—R^4—A)]_w\text{-}[(R^5O)_m(CH_2CH_2O)_n]\text{-}X$ substituent or at least one moiety $—A\text{-}[(R^2—A—R^4—A)]_wR^2—A—$ crosslinked to another $R^3$ moietyp the $R^4$ moieties are $R^1$ or $R^3$ moieties, or a mixture thereof; each $R^5$ is $C_3$–$C_4$ alkylene, or the moiety $—R^2—A—R^6—$, wherein $R^6$ is a $C_1$–$C_{12}$ alkylene, alkenylene, arylene or alkarylene moiety; each M is H or a water-soluble cation; each X is H, $C_1$–$C_4$ alkyl or $$-\overset{O}{\overset{\|}{C}}R^7,$$

wherein $R^7$ is $C_1$–$C_4$ alkyl; m and n are numbers such that the moiety $-(CH_2CH_2O)-$ comprises at least about 50% by weight of the moiety $\text{-}\!\!\{\!\!-R^5O)_m(CH_2CH_2O)_n\!\!\}\!\!\text{-}$, provided that when $R^5$ is the moiety $-R^2-A-R^6-$, m is 1; each n is at least about 10; u and v are numbers such that the sum of u+v+w is from about 3 to about 25.

This latter polymer is particularly preferred when the formula is:

$$X-(OCH_2CH_2)_n\text{-}\!\!\{\!\!-(\overset{O}{\overset{\|}{C}}O-R^1-\overset{O}{\overset{\|}{C}}O-R^2)\!\!\}\!\!\text{-}_u\overset{O}{\overset{\|}{C}}O-R^1-\overset{O}{\overset{\|}{C}}O-(CH_2CH_2O)_n-X$$

wherein each $R^1$ is a 1,4-phenylene moiety; the $R^2$ consist essentially of ethylene moieties, 1,2-propylene moieties or a mixture thereof; each X is ethyl or preferably methyl; each n is from about 12 to about 43; u is from about 3 to about 10.

A preferred polymeric soil release agent is POET (polyoxyethylene terephthalate), a compound with the general formula:

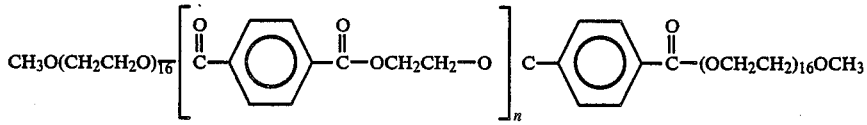

wherein n=1.75 on average.

In general, the soil release polymer is preferably a solid at room temperature, has a softening phase transition temperature at or above 30° C. and becomes a flowable liquid below 100° C., more preferably below 90° C.

OPTIONAL FABRIC SOFTENING AGENTS

Examples of optional fabric softening agents are the compositions described in U.S. Pat. Nos. 4,103,047, Zaki et al., issued July 25, 1978; 4,237,155, Kardouche, issued Dec. 2, 1980; 3,686,025, Morton, issued Aug. 22, 1972; 3,849,435, Diery et al., issued Nov. 19, 1974; and U.S. Pat. No. 4,017,996, Bedenk, issued Feb. 14, 1978; said patents are hereby incorporated herein by reference. Particularly preferred cationic fabric softeners of this type include quaternary ammonium salts such as dialkyl dimethylammonium chlorides, methylsulfates and ethylsulfates wherein the alkyl groups can be the same or different and contain from about 14 to about 22 carbon atoms. Examples of such preferred materials include ditallowalkyldimethylammonium methylsulfate, distearyldimethylammonium methylsulfate, dipalmityldimethylammonium methylsulfate and dibehenyldimethylammonium methylsulfate. Also particularly preferred is the carboxylic acid salt of a tertiary alkylamine disclosed in said Kardouche patent. Examples include stearyldimethylammonium stearate, distearylmethylammonium myristate, stearyldimethylammonium palmitate, distearlymethylammonium palmitate, and distearlymethylammonium laurate. These carboxylic salts can be made in situ by mixing the corresponding amine and carboxylic acid in the molten fabric conditioning composition.

Examples of nonionic fabric softeners are the sorbitan esters, described herein and $C_{12}$–$C_{26}$ fatty alcohols and fatty amines as described herein.

A preferred article of the present invention includes a fabric conditioning composition which additionally comprises from about 10% to about 70% of polymeric soil release agent, and from about 5% to about 90% of an optional fabric softening agent, by weight of the fabric conditioning composition said fabric softening agent is selected from cationic and nonionic fabric softeners, and mixtures thereof. Preferably, the optional fabric softening agent comprises a mixture of a cationic fabric softener and a nonionic fabric softener in a weight ratio of from about 1:10 to about 10:1. The selection of the components is such that the resulting fabric conditioning composition has a melting point above about 38° C. and being flowable at dryer operating temperatures.

Another preferred optional fabric softening agent comprises a mixture of $C_{10}$–$C_{26}$ alkyl sorbitan esters and mixtures thereof, a quaternary ammonium salt and a tertiary alkylamine. The quaternary ammonium salt is preferably present at a level of from about 5% to about 25%, more preferably from about 7% to about 20% of the fabric conditioning composition. The sorbitan ester is preferably present at a level of from about 10% to about 50%, more preferably from about 20% to about 40%, by weight of the total fabric conditioning composition. The tertiary alkylamine is present at a level of from about 5% to about 25%, more preferably from 7% to about 20% by weight of the fabric conditioning composition. The preferred sorbitan ester comprises a member selected from the group consisting of $C_{10}$–$C_{26}$ alkyl sorbitan monoesters and $C_{10}$–$C_{26}$ alkyl sorbitan diesters, and ethoxylates of said esters wherein one or more of the unesterified hydroxyl groups in said esters contain from 1 to about 6 oxyethylene units, and mixtures thereof. The quaternary ammonium salt is preferably in the methylsulfate form. The preferred tertiary alkylamine is selected from the group consisting of alkyldimethylamine and dialkylmethylamine and mixtures thereof, wherein the alkyl groups can be the same or different and contain from about 14 to about 22 carbon atoms.

Another preferred optional fabric softening agent comprises a carboxylic acid salt of a tertiary alkylamine, in combination with a fatty alcohol and a quaternary ammonium salt. The carboxylic acid salt of a tertiary amine is used in the fabric conditioning composition preferably at a level of from about 5% to about 50%, and more preferably, from about 15% to about 35%, by weight of the fabric conditioning composition. The quaternary ammonium salt is used preferably at a level of from about 5% to about 25%, and more preferably, from about 7% to about 20%, by weight of the total fabric conditioning composition. The fatty alcohol can be used preferably at a level of from about 10% to about 25%, and more preferably from about 10% to about 20%, by weight of the fabric conditioning composition. The preferred quaternary ammonium salt is selected from the group consisting of dialkyl dimethylammonium salt wherein the alkyl groups can be the same or different and contain from about 14 to about 22 carbon atoms and wherein the counteranion is selected from the group consisting of chloride, methylsulfate and ethylsulfate, preferably methylsulfate. The preferred carboxylic acid salt of a tertiary alkylamine is selected from the group consisting of fatty acid salts of alkyldimethylamines wherein the alkyl group contains from about 14 to about 22 carbon atoms. The preferred fatty alcohol contains from about 14 to about 22 carbon atoms.

Clays can be added to the compositions of the invention in an amount of from about 0.5% to about 50% of the total composition. See U.S. Pat. No. 4,073,996, Bedenk et al., issued Feb. 14, 1978. Clay promotes even release of the softening composition from substrate-type dispensing means (such as woven or nonwoven cloth sheets) thereby minimizing any tendency to stain the treated fabrics which might be caused by uneven transfer of softener to them. Smectite and montmorillonite clays are particularly preferred clays for use herein. An example of a smectite clay is Gelwhite GP, which is marketed by Georgia Kaolin Co. An example of a montmorillonite clay is Bentolite L, which is marketed by Southern Clay Products. Another additive which can be used to promote even release of the softener composition from a substrate-type dispensing means is a mixture of about 1.5% Carbopol resin (B. F. Goodrich Co.) and 4% glycerine, based on the total weight of the composition.

OTHER OPTIONAL INGREDIENTS

Well-known optional components included in the fabric conditioning composition which are useful in the present invention are narrated in U.S. Pat. No. 4,103,047, Zaki et al., issued July 25, 1978, for "Fabric Treatment Compositions," incorporated herein by reference. Such optional components include anti-creasing agents, finishing agents, fumigants, lubricants, fungicides, and sizing agents. The amounts of these additives will generally comprise from about 0.01% to about 10.0% by weight of the fabric conditioning agent.

DISPENSING MEANS

The fabric conditioning compositions can be employed by simply adding a measured amount into the dryer, e.g., as liquid dispersion. However, in a preferred embodiment, the fabric conditioners are provided as an article of manufacture in combination with a dispensing means such as a flexible substrate which effectively releases the composition in an automatic clothes dryer. Such dispensing means can be designed for single usage or for multiple uses.

One such article comprises a sponge or porous material releasably enclosing enough fabric conditioning composition to effectively impart fabric care benefits during several cycles of clothes. Such a substrate will have a weight ratio of fabric conditioning agent to dry substrate on a dry weight basis ranging from about 10:1 to about 0.25:1. This multi-use article can be made by filling, for example, a hollow sponge with about 20 grams of the fabric conditioning composition.

Other devices and articles suitable for dispensing the fabric conditioning composition into automatic dryers include those described in U.S. Pat. Nos. 4,103,047, Zaki et al., issued July 25, 1978; 3, 736,668, Dillarstone, issued June 5, 1973; 3,701,202, Compa et al., issued Oct. 31, 1972; 3,634,947, Furgal, issued Jan. 18, 1972; 3,633,538, Hoeflin, issued Jan. 11, 1972; and 3,435,537, Rumsey, issued Apr. 1, 1969. All of these patents are incorporated herein by reference.

A highly preferred article herein comprises the fabric conditioning composition releasably affixed to a flexible substrate in a sheet configuration. Highly preferred paper, woven or nonwoven "absorbent" substrates useful herein are fully disclosed in Morton, U.S. Pat. No. 3,686,026, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from about 4 to about 12, preferably about 5 to about 7, times its weight of water.

Determination of absorbent capacity values is made by using the capacity testing procedures described in U.S. Federal Specifications UU-T-595b, modified as follows:

1. tap water is used instead of distilled water
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of about 3.5 to about 4, commercially available household one-ply toweling paper has a value of about 5 to about 6; and commercially available two-ply household toweling paper has a value of 7 to about 9.5.

Using a substrate with an absorbent capacity of less than 4 tends to cause too rapid release of the fabric conditioning composition from the substrate resulting in several disadvantages, one of which is uneven conditioning of the fabrics. Using a substrate with an absorbent capacity over about 12 is undesirable, inasmuch as too little of the fabric conditioning composition is released to condition the fabrics in optimal fashion during a normal drying cycle.

Such a substrate comprises a nonwoven cloth having an absorbent capacity of preferably from about 5 to about 7 and wherein the weight ratio of fabric conditioning composition to substrate on a dry weight basis ranges from about 5:1 to about 1:1.

Nonwoven cloth substrate preferably comprises cellulosic fibers having a length of from about 3/16 inch to about 2 inches and a denier of from about 2.5 to about 5 and the substrate is adhesively bonded together with a binder resin.

The flexible substrate preferably has openings sufficient in size and number to reduce restriction by said article of the flow of air through an automatic laundry dryer. The better openings comprise a plurality of rectilinear slits extended along one dimension of the substrate.

ARTICLE MANUFACTURE

The articles herein comprise imidazoline-anionic surfactant ion-pair complex conditioner compositions in combination with any dispensing means suitable for releasing the conditioning composition to the fabric load at temperatures encountered in automatic laundry dryers. Preferred articles herein are those wherein the conditioning composition is releasably affixed to an absorbent substrate as an impregnate or as a coating. The impregnation or coating can be accomplished in any convenient manner, and many methods are known in the art. For example, the conditioning composition, in liquid form, can be sprayed onto a substrate or cann be added to a wood-pulp slurry from which the substrate is manufactured.

Impregnating, rather than coating, the substrate with the conditioner composition is highly preferred for optimal conditioning with minimal fabric staining. The term "coating" connotes the adjoining of one substance to the external surface of another; "impregnating" is intended to mean the permeation of the entire substrate structure, internally as well as externally. One factor affecting a given substrate's absorbent capacity is its free space. Accordingly, when a conditioning composition is applied to an absorbent substrate, it penetrates into the free space; hence, the substrate is deemed impregnated. The free space in a substrate of low absorbency, such as a one-ply kraft or bond paper, is very limited; such a substrate, is therefore, deemed "dense." Thus, while a small portion of the conditioning composition penetrates into the limited free space available in a dense substrate, a rather substantial balance of the conditioner composition does not penetrate and remains on the surface of the substrate so that it is deemed a coating. The difference between coating and impregnation is believed to explain why the conditioner-impregnated sheet substrates of the invention herein substantially reduce the staining of fabrics observed when a conditioner-coated dense substrate is utilized.

In one method of making the preferred conditioner-impregnated absorbent sheet substrate, a conditioner composition containing an imidazoline-anionic surfactant ion-pair, alone or with the optional additives, is applied to absorbent paper or nonwoven cloth by a method generally known as "padding." The conditioning composition is preferably applied in liquid form to the substrate. Thus, the conditioner composition, which is normally solid at room temperature should first be melted and/or solvent treated. Methods of melting the conditioner composition and/or for treating the conditioner composition with a solvent are known and can easily be done to provide a satisfactory conditioner-treated substrate.

In another preferred method, the conditioner composition, in liquified form, is placed in a pan or trough which can be heated to maintain the conditioner composition in liquid form. The liquid conditioner composition contains any of the desired optional additives. A roll of absorbent paper (or cloth) is then set up on an apparatus so that it can unroll freely. As the paper or cloth unrolls, it travels downwardly and, submersed, passes through the pan or trough containing the liquid fabric conditioning composition at a slow enough speed to allow sufficient impregnation. The absorbent paper or cloth then travels upwardly and through a pair of rollers which remove excess bath liquid and provide the absorbent paper or cloth with about 1 to about 12 grams of the conditioning composition per 100 sq. inches to 150 sq. inches (645 to 968 sq. cm) of substrate sheet. The impregnated paper or cloth is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the opening between their respective surfaces can be regulated to control the amount of the conditioner composition liquid on the paper or cloth.

In applying the conditioner composition to the absorbent substrate, the amount of conditioner composition (excluding any solvent which may have been used in the process) impregnated into or coated onto the absorbent substrate is conveniently in the weight ratio range of from about 10:1 to 0.25:1 based on the ratio of total conditioner composition to dry, untreated substrate (fiber plus binder). Preferably, the ratio of conditioner composition to dry, untreated substrate ranges from about 5:1 to about 1:1, most preferably from about 3:1 to about 1:1. As noted above, the conditioning composition can contain from 5% to 100% of one or more of imidazoline-anionic surfactant ion-pair conditioning agent.

Following application of the liquified conditioner composition, the articles are held at room temperature until the conditioner composition solidifies. The resulting dry articles, prepared at the conditioner composition:substrate ratios set forth above, remain flexible; the sheet articles are suitable for packaging in rolls. The sheet articles can optionally be slitted or punched to provide a non-blocking aspect (as described previously) at any convenient time during the manufacturing process.

The most highly preferred articles herein are those where the conditioner composition is releasably affixed to a woven or nonwoven cloth substrate of the type disclosed hereinabove having an absorbent capacity of from about 2 to about 15. A highly preferred substrate for such an article has an absorbent capacity of from about 5 to 7. The most highly preferred substrate for the articles comprises a water-laid or air-laid nonwoven cloth consisting essentially of cellulosic fibers, said fibers having a length of about 3/16 inch to about 2 inches and a denier from about 1.5 to about 5, said fibers being at least partially oriented haphazardly, and adhesively bonded together with a binder-resin. Such water-laid or air-laid nonwoven cloths can easily be prepared having the preferred absorbent capacities set forth above.

The most highly preferred articles herein are those wherein the flexible substrate is provided with openings sufficient in size and number to reduce restriction by said article of the flow of air through the automatic dryer. Articles wherein the openings comprise a plurality of rectilinear slits extending along one dimension of the substrate, especially those wherein the slits extend to within 1 inch from at least one edge of said dimension of the substrate, articles wherein the slits comprise a plurality of curvilinear slits in a continuous pattern of U-shaped or C-shaped slits, and articles wherein the openings comprise circular holes, are highly preferred herein.

It is most convenient to provide an article in the form of a nonblocking sheet substrate having the physical parameters noted hereinabove, said substrate having an area of from about 50 sq. in. to about 200 sq. in. (322 sq. cm. to 1290 sq. cm.), containing from about 1.5 grams to about 7.5 grams of the conditioning composition releasably impregnated in said substrate. The articles are provided with openings such as the holes or slits described hereinabove, said openings comprising from about 0.5% to about 75%, preferably 5% to about 40%, of the area of the article, said openings being so disposed as to provide a nonblocking effect.

Usage

The method aspect of this invention for imparting the above-described fabric conditioning composition to provide static control, softening and optional soil release benefits to fabrics in an automatic laundry dryer comprises: commingling pieces of damp fabrics by tumbling said fabrics under heat in an automatic clothes dryer with an effective amount of the fabric conditioning composition, said composition being flowable at dryer operating temperature, and said composition comprising from about 30% to about 99% of a fabric conditioning agent selected from one or more of the imidazoline-anionic surfactant ion-pair complexes. Other cationic and nonionic fabric softeners and mixtures thereof; and said composition additionally comprising from about 1% to about 70% of a polymeric soil release agent.

The method herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. The fabric conditioning composition can simply be spread uniformly over all fabric surfaces, for example, by sprinkling the composition onto the fabrics from a shaker device. Alternatively, the composition can be sprayed or otherwise coated on a dryer drum, itself. The dryer is then operated in standard fashion to dry the fabrics, usually at a temperature from about 50° C. to about 80° C. for a period from about 10 minutes to about 60 minutes, depending on the fabric load and type. On removal from the dryer, the dried fabrics have been treated for static control, softening and, optionally, soil release benefits.

In a preferred mode, the present process is carried out by fashioning an article comprising the substrate-like dispensing means of the type hereinabove described in releasable combination with a fabric conditioning composition. This article is simply added to a clothes dryer together with the damp fabrics to be treated. The heat and tumbling action of the revolving dryer drum evenly distributes the composition over all fabric surfaces, providing the fabric conditioning benefits and drying the fabrics.

EXAMPLES

The following examples illustrate the present invention. The abbreviations used are:

ETPG: ethylene terephthalate-polyoxyethylene glycol copolymer (Zelcon 4780 sold by E. I. duPont as a 15% dispersion in water). Dried Zelcon 4780 is the dehydrated dispersion dried in a thin film at approximately 100° C. Zelcon 4780 is also described herein in the section entitled "Polymeric Soil Release Agent."

Milease T: ethylene terephthalate-polyoxyethylene glycol copolymer (sold by ICI as a 15% dispersion in water). Dried Milease T is the dehydrated dispersion dried in a thin film at approximately 100° C. This polymer is further described in the section herein entitled "Polymeric Soil Release Agent."

POET: polyoxyethylene terephthalate is a compound with the general formula described hereinabove. It is synthesized from the following reactants:

1. Poly(ethylene glycol)methyl ester, M.W. 750, Aldrich Chemical Co., 1000 g (1.33 moles)
2. Dimethyl terephthalate, M.W. 195, Alsrich Chemical Co., 359.9 g (1.85 moles)
3. Ethylene glycol, M.W. 62, Alsrich Chemical Co., 146.4 g (2.36 moles)
4. Calcium acetate, MCB, 7.9 g (catalyst)
5. Antimony trioxide, Fisher Scientific, 7.9 g (catalyst)
6. Butylated hydroxytoluene, Aldrich Chemical Co., 3.6 g (antioxidant).

The resulting polymer is submitted to a three-solvent (short chain alcohols) extraction (IPA, EtOH, MeOH) and the EtOH, MeOH soluble fractions are combined in the ratio of 67:33.

Methocel A15LV: methyl cellulose sole by Dow Chemical Co.

DTDMAMS: ditallowdimethylammonium methylsulfate

DTMA: ditallowmethylamine

SMS: sorbitanmonostearate

SDMA: stearyldimethylamine

Parvan 5250: petroleum wax sold by Exxon Chemical

PEG 8000: polyethylene glycol

Clay: Bentolite L, a montmorillonite clay, obtained from Southern Clay Products

Imidazoline-$C_{13}$ LAS: hydrogenated tallow amidoethyl-2-hydrogenated tallow imidazoline-linear $C_{13}$ alkyl benzene sulfonate ion-pair complex Coco-imidazoline-$C_{13}$LAS: coconut amide ethyl-2-coconut imidazoline-linear $C_{13}$ alkyl benzene sulfonate ion-pair complex

EXAMPLE I

| | Wt. % |
|---|---|
| Fabric Conditioning Composition Components | |
| ETPG | 37.0 |
| DTDMAMS | 12.0 |
| SMS | 10.0 |
| Imidazoline-$C_{13}$LAS | 34.0 |
| Clay | 6.0 |
| Perfume | 1.0 |
| Dryer-added Sheet Substrate Composition | |
| Rayon fibers | 70 |
| Polyvinyl acetate | 30 |
| (10" × 14" sheets, 1.4 gm) | |

The imidazoline-$C_{13}$LAS ion-pair complex is formed by combining a 4:1 mole ratio of hydrogenated tallow amido ethyl-2-hydrogenated tallow imidazoline (available from Sherex Chemical Corp. Dublin, Ohio as Varisoft ® 445 imidazoline) and linear $C_{13}$ alkylbenzenesulfonate (acid form). The resulting mixture is heated to about 85° C. with agitation in a beaker to give a homogeneous fluid. After adjusting the final pH to approximately 6, the mixture is allowed to cool down to room temperature with stirring. The ion-pair is co-melted with other softener actives, soil release polymer, clay, and perfume. The substrate (made of the rayon fibers with polyvinyl acetate) is then coated with about 4 grams of the molten actives and dried overnight. This provides a weight ratio of fabric conditioning composition: dry substrate of approximately 3.

Following solidification of the fabric conditioning composition, the substrate is slit with a knife, said slits being in substantially parallel relationship and extending to within about 1 inch from at least one edge of said substrate. The width of an individual slit is approximately 0.2 inches. These dryer added sheets are added to a clothes dryer together with damp fabrics to be treated. The heat and tumbling action of the revolving dryer drums evenly distributes the composition over all fabrics, and dries the fabrics.

The dryer added sheets provide excellent fabric care benefits such as softening, static control, and soil release.

Substantially similar results are obtained when the imidazoline $C_{13}$LAS ion-pair complex is replaced in whole or in part with an equivalent amount of:

stearylamidoethyl-2-stearyl imidazoline complexed with a $C_1$–$C_{20}$ LAS,
stearylamidoethyl-2-palmityl imidazoline complexed with a $C_1$–$C_{20}$ LAS,
stearylamidoethyl-2-myristyl imidazoline complexed with a $C_1$–$C_{20}$ LAS,
palmitylamidoethyl-2-palmityl imidazoline complexed with a $C_1$–$C_{20}$ LAS,
palmitylamidoethyl-2-myristyl imidazoline complexed with a $C_1$–$C_{20}$ LAS,
stearylamidoethyl-2-tallow imidazoline complexed with a $C_1$–$C_{20}$ LAS,
myristylamidoethyl-2-tallow imidazoline complexed with a $C_1$–$C_{20}$ LAS,
palmitylamidoethyl-2-tallow imidazoline complexed with a $C_1$–$C_{20}$ LAS,
coconut amidoethyl-2-coconut imidazoline complexed with a $C_1$–$C_{20}$ LAS,
tallowamidoethyl-2-tallow imidazoline complexed with a $C_1$–$C_{20}$ LAS,
stearylamidoethyl-2-stearyl imidazoline complexed with a $C_1$–$C_{20}$ AES,
stearylamidoethyl-2-palmityl imidazoline complexed with a $C_1$–$C_{20}$ AES,
stearylamindoethyl-2-myristyl imidazoline complexed with a $C_1$–$C_{20}$ AES,
palmitylamidoethyl-2-palmityl imidazoline complexed with a $C_1$–$C_{20}$ AES,
palmitylamidoethyl-2-myristyl imidazoline complexed with a $C_1$–$C_{20}$ AES,
stearylamidoethyl-2-tallow imidazoline complexed with a $C_1$–$C_{20}$ AES,
myristylamidoethyl-2-tallow imidazoline complexed with a $C_1$–$C_{20}$ AES,
palmitylamidoethyl-2-tallow imidazoline complexed with a $C_1$–$C_{20}$ AES,
coconut amidoethyl-2-coconut imidazoline complexed with a $C_1$–$C_{20}$ AES,
tallowamidoethyl-2-tallow imidazoline complexed with a $C_1$–$C_{20}$ AS,
stearylamidoethyl-2-stearyl imidazoline complexed with an aryl sulfonate,
stearylamidoethyl-2-palmityl imidazoline complexed with an aryl sulfonate,
stearylamidoethyl-2-myristyl imidazoline complexed with an aryl sulfonate,
palmitylamidoethyl-2-palmityl imidazoline complexed with an aryl sulfonate,
palmitylamidoethyl-2-myristyl imidazoline complexed with an aryl sulfonate,
stearylamidoethyl-2-tallow imidazoline complexed with an aryl sulfonate,
myristylamidoethyl-2-tallow imidazoline complexed with an aryl sulfonate,
palmitylamidoethyl-2-tallow imidazoline complexed with an aryl sulfonate,
coconut amidoethyl-2-coconut imidazoline complexed with an aryl sulfonate,
tallowamidoethyl-2-tallow imidazoline complexed with an aryl sulfonate and mixtures thereof.

EXAMPLE II–X

The following dryer added sheet compositions are representative of the present invention and are made as described above in Example I.

| | Examples | | | | | | | | |
|---|---|---|---|---|---|---|---|---|---|
| | II | III | IV | V | VI | VII | VIII | IX | X |
| Components | Wt. % | Wt. % | Wt. % | Wt. % | Wt. % | Wt. % | Wt. % | Wt. % | Wt. % |
| ETPG-1 | 43.0 | — | 24.2 | — | — | — | 21.1 | — | — |
| POET | — | 24.2 | — | — | 37.5 | — | — | 37 | — |
| Cellulose | — | — | — | 25.1 | — | 10 | — | — | — |
| DTMAMS | 10.0 | 12.7 | 12.7 | 12.25 | 11.25 | 15 | 11.1 | — | 24.0 |
| DTMA | 1.0 | 12.7 | 12.7 | 12.25 | 0.75 | 15 | — | — | — |
| SMS | 14.6 | 25.4 | 25.4 | 25.4 | 8.0 | 30.0 | — | 33.0 | 20.0 |
| SDMA | — | — | — | — | — | — | 13.9 | — | — |
| $C_{16}$–$C_{18}$ fatty acid | — | — | — | — | — | — | 12.8 | — | — |
| $C_{16}$–$C_{18}$ fatty alcohol | — | — | — | — | — | — | 11.1 | — | — |
| PEG 8000 | — | — | — | — | 12.5 | — | — | — | — |
| Clay | 6.4 | — | — | — | — | — | — | — | 6.0 |
| Imidazoline-$C_{13}$LAS | 25.0 | — | — | 25.0 | 30.0 | 30.0 | — | — | 30.0 |
| Coco-imidazoline-$C_{13}$LAS | — | 25.0 | 25.0 | — | — | — | 30.0 | 30.0 | — |
| Dryer-added Sheet Substrate Composition (10 inch × 14 inch sheets, 1.4 grams) | | | | | | | | | |
| Rayon fibers | 70 | 70 | 70 | 70 | 70 | 70 | 70 | 70 | 70 |
| Polyvinyl acetate | 30 | 30 | 30 | 30 | 30 | 30 | 30 | 30 | 30 |
| Ratio of fabric conditioner:softener | 3 | 3 | 3 | 3 | 3 | 3 | 3 | 3 | 3 |

The resulting dryer added sheets exhibit excellent fabric care benefits such as softening, static control, and soil release.

What is claimed is:

1. An article of manufacture adapted for use to provide fabric care benefits in an automatic laundry dryer comprising:

(a) a fabric conditioning composition comprising one or more of an imidazoline-anionic surfactant ion-pair complex of the formula:

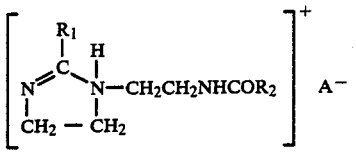

wherein $R_1$ and $R_2$ can independently be $C_{12}$ to $C_{20}$ hydrocarbon, and A is an anionic surfactant selected from the group consisting of aryl sulfonates, alkylaryl sulfonates, paraffin sulfonates, olefin sulfonates, alkyl ethoxylated sulfates, dialkyl sulfosuccinates, ethoxylated alkyl sulfonates, alkyl oxybenzene sulfonates, acyl isethionated acylalkyl taurates and mixtures of such ion-pair complexes; and (b) a dispensing means which provides for release of an effective amount of said composition to fabrics in the dryer at automatic dryer operating temperatures, said dispensing means comprising a flexible substrate in sheet configuration having the fabric conditioning composition releasably affixed thereto to provide a weight ratio of fabric conditioning composition to dry substrate ranging from about 10:1 to about 0.25:1.

2. An article according to claim 1 wherein A is selected from the group consisting of linear $C_1$ to $C_{20}$ alkylaryl sulfonates, aryl sulfonates, alkyl ethoxylated sulfates and sulfosuccinates.

3. An article according to claim 2 wherein the weight ratio of fabric conditioning composition:dry substrate ranges from about 5:1 to about 1:1.

4. An article according to claim 3 wherein $R_1$ and $R_2$ are independently $C_{12}$ to $C_{20}$ alkane or alkene.

5. An article according to claim 4 wherein A is selected from the group consisting of linear $C_1$ to $C_{20}$ alkyl benzene sulfonates.

6. An article according to claim 5 wherein $R_1$ and $R_2$ are independently $C_{14}$ to $C_{20}$ alkane.

7. An article according to claim 6 wherein $R_1$ and $R_2$ are independently $C_{16}$ to $C_{20}$ alkane.

8. An article according to claim 7 wherein $R_1$ and $R_2$ are independently $C_{16}$ to $C_{18}$ alkane.

9. An article according to claim 8 additionally comprising from about 5% to about 90% of an optional fabric softening agent by weight of the fabric conditioning composition, selected from the group consisting of cationic fabric softeners and nonionic fabric softeners, and mixtures thereof.

10. An article according to claim 9 wherein said fabric softening agent comprises a mixture of cationic fabric softener and nonionic fabric softeners in a weight ratio of from about 1:10 to about 10:1.

11. An article according to claim 1 wherein said cationic fabric softener is selected from the group consisting of a quaternary ammonium salt, a carboxylic acid of a tertiary alkyl amine, and mixtures thereof and wherein said nonionic fabric softener is selected from the group consisting of a fatty alkyl sorbitan ester, a fatty alcohol, a fatty amine, and mixtures thereof.

12. An article according to claim 11 further containing a polymeric soil release agent, said soil release agent being a hydroxyether cellulosic polymer.

13. An article according to claim 12 wherein said polymeric soil release agent is selected from the group consisting of methylcellulose, hydroxypropyl methylcellulose, and hydroxybutyl methylcellulose, and mixtures thereof.

14. An article according to claim 13 wherein said ion-pair complex at room temperature, has a softening phase transition of at least about 30° C. and becomes a flowable liquid below 100° C.

15. An article according to claim 1 wherein said dispensing means comprises a sponge material releasably enclosing the fabric conditioning composition wherein the weight ratio of fabric conditioning agent to dry substrate ranges from about 10:1 to about 0.5:1.

16. An article according to claim 14 wherein said ion-pair complex is selected from the group consisting of stearylamidoethyl-2-stearyl imidazoline complexed with a $C_1$–$C_{20}$ alkyl benzene sulfonate,
stearylamidoethyl-2-palmityl imidazoline complexed with a $C_1$–$C_{20}$ alkyl benzene sulfonate,
stearylamidoethyl-2-myristyl imidazoline complexed with a $C_1$–$C_{20}$ alkyl benzene sulfonate,
palmitylamidoethyl-2-palmityl imidazoline complexed with a $C_1$–$C_{20}$ alkyl benzene sulfonate,
palmitylamidoethyl-2-myristyl imidazoline complexed with a $C_1$–$C_{20}$ alkyl benzene sulfonate,
stearylamidoethyl-2-tallow imidazoline complexed with a $C_1$–$C_{20}$ alkyl benzene sulfonate,
myristylamidoethyl-2-tallow imidazoline complexed with a $C_1$–$C_{20}$ alkyl benzene sulfonate,
palmitylamidoethyl-2-tallow imidazoline complexed with a $C_1$–$C_{20}$ alkyl benzene sulfonate,
coconut amidoethyl-2-coconut imidazoline complexed with a $C_1$–$C_{20}$ alkyl benzene sulfonate,
tallowamidoethyl-2-tallow imidazoline complexed with a $C_1$–$C_{20}$ alkyl, benzene sulfonate,
stearylamidoethyl-2-stearyl imidazoline complexed with a $C_1$–$C_{20}$ alkyl ethoxylated sulfate,
stearylamidoethyl-2-palmityl imidazoline complexed with a $C_1$–$C_{20}$ alkyl ethoxylated sulfate,
stearylamidoethyl-2-myristyl imidazoline complexed with a $C_1$–$C_{20}$ alkyl ethoxylated sulfate,
palmitylamidoethyl-2-palmityl imidazoline complexed with a $C_1$–$C_{20}$ alkyl ethoxylated sulfate,
palmitylamidoethyl-2-myristyl imidazoline complexed with a $C_1$–$C_{20}$ alkyl ethoxylated sulfate,
stearylamidoethyl-2-tallow imidazoline complexed with a $C_1$–$C_{20}$ alkyl ethoxylated sulfate,
myristylamidoethyl-2-tallow imidazoline complexed with a $C_1$–$C_{20}$ alkyl ethoxylated sulfate,
palmitylamidoethyl-2-tallow imidazoline complexed with a $C_1$–$C_{20}$ alkyl ethoxylated sulfate,
coconut amidoethyl-2-coconut imidazoline complexed with a $C_1$–$C_{20}$ alkyl ethoxylated sulfate,
tallowamidoethyl-2-tallow imidazoline complexed with a $C_1$–$C_{20}$ alkyl ethoxylated sulfate,
stearylamidoethyl-2-stearyl imidazoline complexed with an aryl sulfonate,
stearylamidoethyl-2-palmityl imidazoline complexed with an aryl sulfonate,
stearylamidoethyl-2-myristyl imidazoline complexed with an aryl sulfonate,
palmitylamidoethyl-2-palmityl imidazoline complexed with an aryl sulfonate,
palmitylamidoethyl-2-myristyl imidazoline complexed with an aryl sulfonate,
stearylamidoethyl-2-tallow imidazoline complexed with an aryl sulfonate, myristylamidoethyl-2-tallow imidazoline complexed with an aryl sulfonate,
palmitylamidoethyl-2-tallow imidazoline complexed with an aryl sulfonate,
coconut amidoethyl-2-coconut imidazoline complexed with an aryl sulfonate,
tallowamidoethyl-2-tallow imidazoline complexed with an aryl sulfonate and mixtures thereof.

* * * * *

UNITED STATES PATENT AND TRADEMARK OFFICE

CERTIFICATE OF CORRECTION

PATENT NO. : 4,756,850

DATED : July 12, 1988

INVENTOR(S) : Bala C. Nayar

It is certified that error appears in the above-identified patent and that said Letters Patent are hereby corrected as shown below:

Column 18, lines 17, 19, 21, 23, 25, 27, 29, 31, and 33, "alkyl benzene sulfonate" should be -- linear alkyl benzene sulfonate--.

Column 18, line 35, "alkyl, benzene sulfonate" should be --linear alkyl benzene sulfonate--.

Signed and Sealed this

Twenty-first Day of February, 1989

*Attest:*

DONALD J. QUIGG

*Attesting Officer*

*Commissioner of Patents and Trademarks*